US007862016B2

(12) United States Patent
Takemoto et al.

(10) Patent No.: US 7,862,016 B2
(45) Date of Patent: Jan. 4, 2011

(54) SHEET STACKING MECHANISM, SHEET FOLDING DEVICE, SHEET POST-PROCESSING APPARATUS AND IMAGE FORMING APPARATUS

(75) Inventors: Mitsutoshi Takemoto, Osaka (JP); Sachio Izumichi, Osaka (JP)

(73) Assignee: Kyocera Mita Corporation (JP)

( * ) Notice: Subject to any disclaimer, the term of this patent is extended or adjusted under 35 U.S.C. 154(b) by 432 days.

(21) Appl. No.: 11/604,966

(22) Filed: Nov. 28, 2006

(65) Prior Publication Data

US 2007/0120308 A1 May 31, 2007

(30) Foreign Application Priority Data

Nov. 30, 2005 (JP) ..... 2005-345706

(51) Int. Cl.
*B65H 37/04* (2006.01)

(52) U.S. Cl. ..... 270/37; 270/17; 270/20.1; 270/32; 270/45; 270/51; 270/58.07; 270/58.08; 270/58.12

(58) Field of Classification Search ..... 270/17, 270/20.1, 32, 37, 45, 51, 58.07, 58.08, 58.12
See application file for complete search history.

(56) References Cited

U.S. PATENT DOCUMENTS 6,022,011 A * 2/2000 Hirose ..... 270/37
6,209,864 B1 * 4/2001 Taniguchi et al. ..... 271/220
6,779,790 B2 * 8/2004 Kitahara ..... 270/58.12
7,052,005 B2 * 5/2006 Yamakawa et al. ..... 270/37
2003/0227121 A1 * 12/2003 Yamakawa et al. ..... 270/37

FOREIGN PATENT DOCUMENTS

| | | |
|---|---|---|
| JP | 3423462 | 9/1996 |
| JP | 201-171889 | 6/2001 |
| JP | 2001-348153 | 12/2001 |
| JP | 2002-167120 | 6/2002 |
| JP | 2004-284762 | 10/2004 |
| JP | 2005-82306 | 3/2005 |
| JP | 2005-96913 | 4/2005 |

* cited by examiner

*Primary Examiner*—Leslie A Nicholson, III
(74) *Attorney, Agent, or Firm*—Gerald E. Hespos; Michael J. Porco

(57) ABSTRACT

A receiving member for receiving the leading end of sheet on a sheet placing table is disposed movably along the upper surface of the sheet placing table within a specified range including a first position located at the other end of the sheet placing table and distanced from a carry-in opening at least by the length of the sheet, and an operation control unit causes the receiving member to move to a second position where the trailing end of the sheet received by the receiving member slips under the carry-in opening.

18 Claims, 8 Drawing Sheets

SHEET STACKING MECHANISM, SHEET FOLDING DEVICE, SHEET POST-PROCESSING APPARATUS AND IMAGE FORMING APPARATUS

BACKGROUND OF THE INVENTION

1. Field of the Invention

The present invention relates to a sheet stacking mechanism for successively stacking sheets being carried in from a carry-in opening on the upper surface of a sheet placing table, a sheet folding device, a sheet post-processing apparatus and an image forming apparatus provided with the sheet stacking mechanism.

2. Description of the Related Art

Some of image forming apparatuses include post-processing apparatuses such as a sheet middle-folding device as disclosed in Japanese Unexamined Patent Publication No. 2002-167120. A sheet stacking mechanism is provided in this sheet middle-folding device. However, since this sheet stacking mechanism has a mere construction of providing a pair of carry-in rollers at a carry-in opening for sheets, there is a likelihood that, upon receiving a sheet fed from the sheet post-processing apparatus, the trailing end of this sheet comes into contact with the leading end of a succeeding sheet, thereby causing a jam.

As means for solving such a problem, a processing tray includes a sheet stocking portion having a paddle for pressing a sheet in a guiding path for guiding the sheet, and a succeeding sheet is further stocked with the trailing end of the previously stocked sheet pressed by the paddle, for example, in Japanese Unexamined Patent Publication No. 2001-171889 although this technology is not applied to a sheet middle-folding device as described above. Accordingly, an occurrence of a jam caused by the collision of sheets can be prevented and even folded sheets can be stocked without causing any jam. This publication discloses that a high-speed processing can be carried out since the above makes it unnecessary to stop the conveyance of sheets during the application of stapling as a post-processing to a stack of sheets.

Further, Japanese Patent Publication No. 3423462 discloses the arrangement of a paddle for pressing an upstream end of a stapled stack of sheets with respect to a sheet discharging direction in a discharge tray.

However, even with the technologies disclosed in the latter two publications, if a sheet is stacked in an unstable state such as a curled state upon being stored, it is difficult to solve problems such as the switch of sheets (disorder in numbering) caused by a succeeding sheet having slipped in a clearance between the curled sheet and the sheet right below it or a tray and an occurrence of a jam caused by the collision of sheets. There have been also problems such as a loud hitting sound (noise) of the paddle when the stacked sheets are moved toward one end by the paddle in order to prevent the above switch of sheets.

SUMMARY OF THE INVENTION

In view of the above problems residing in the prior art, an object of the present invention is to prevent a disorder in the numbering of stacked sheets and to securely prevent an occurrence of a conveyance jam by a sheet collision.

The present invention is directed to a sheet stacking mechanism, comprising a sheet placing table having one end of the upper surface thereof arranged at the side of a carry-in opening for sheets and having sheets carried in from the carry-in opening successively stacked on the upper surface thereof; a receiving member disposed movably along the upper surface of the sheet placing table within a specified range including a first position located at the other end of the sheet placing table and distanced from the carry-in opening at least by the length of the sheet on the sheet placing table and adapted to receive the leading end of the sheet on the sheet placing table; and an operation control unit for performing a control of moving the receiving member to the first position and a control of moving the receiving member to a second position where the trailing end of the sheet slips under the carry-in opening.

According to the present invention, the receiving member for receiving the leading end of the sheet on the sheet placing table is disposed movably along the upper surface of the sheet placing table within the specified range including the first position located at the other end of the sheet placing table and distanced from the carry-in opening at least by the length of the sheet on the sheet placing table, and the operation control unit causes the receiving member to move to the second position where the trailing end of the sheet received by the receiving member slips under the carry-in opening. Thus, even if the sheets are stacked in an unstable state such as in a curled state, the leading end of a succeeding sheet carried onto the sheet placing table from the carry-in opening can be located on the sheet already stacked on the sheet placing table. Therefore, there is no problem such as the switch of sheets (disorder in numbering) caused by a succeeding sheet having slipped in a clearance between the sheets or the sheet and the sheet placing table, for example, due to a curled state of the sheet and an occurrence of a jam caused by the collision of sheets.

Further, since no paddle is used to prevent the switch of the sheets, there is no problem of loud hitting sounds (noise) of the paddle. As a result, it is possible to prevent a disorder in the numbering of stacked sheets without creating any noise and to securely prevent an occurrence of a conveyance jam by a collision.

DETAILED DESCRIPTION OF THE PREFERRED EMBODIMENTS

Hereinafter, a sheet stacking mechanism, a sheet folding device, a sheet post-processing apparatus and an image forming apparatus according to one embodiment of the present invention are described with reference to the accompanying drawings.

Figure 1:
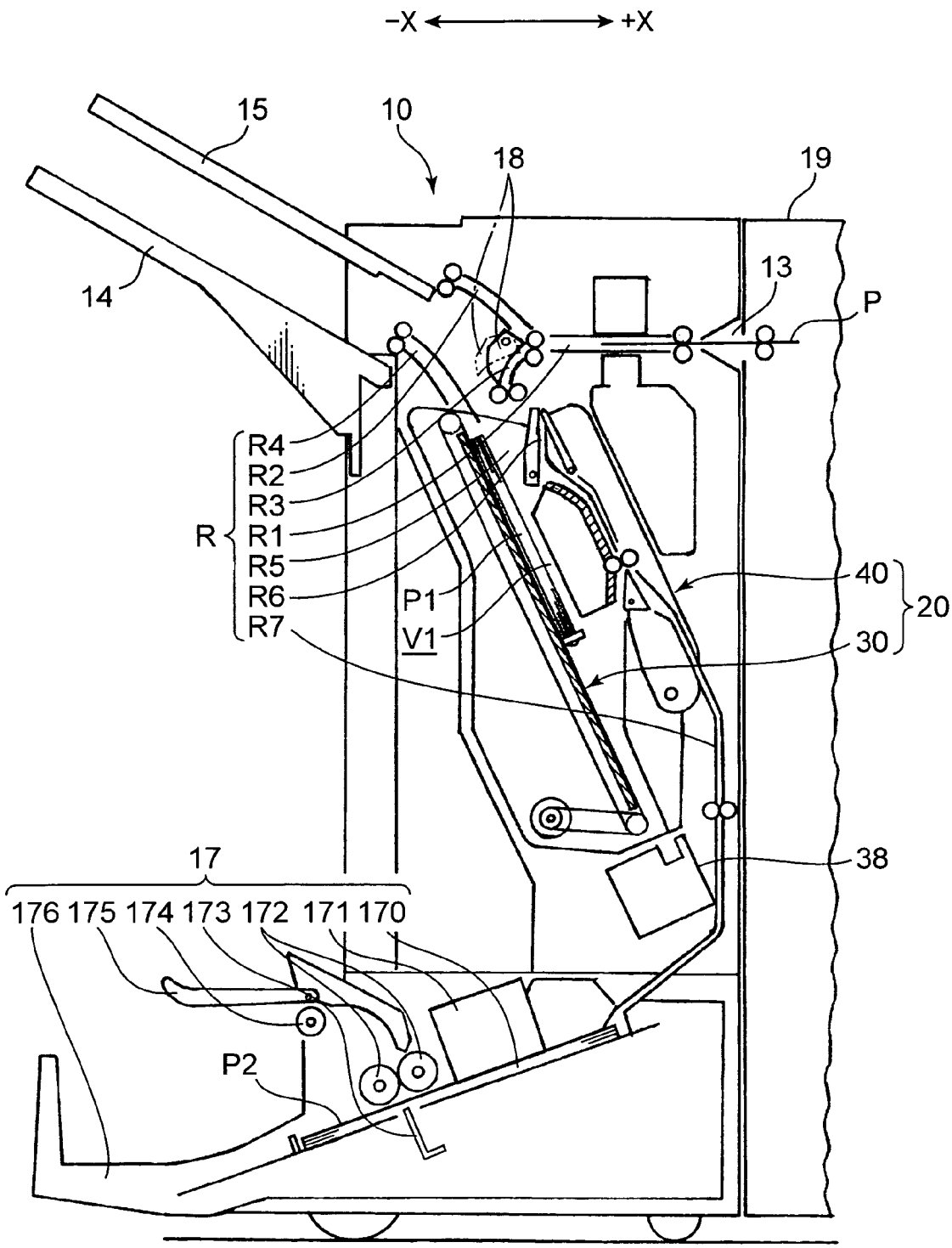
FIG. 1 is a front view in section showing a schematic construction of a sheet post-processing apparatus having a built-in middle-folding unit according to one embodiment of the invention.

FIG. 1 is a front view in section showing a schematic construction of a sheet post-processing apparatus 10 according to one embodiment of the present invention. It should be noted that +X, −X in FIG. 1 denote right side and left side respectively. As shown in FIG. 1, sheet conveyance paths R for conveying a sheet P fed from an image forming apparatus 19 to the respective locations depending on the purpose are formed in the post-processing apparatus 10.

The sheet conveyance paths R include an entrance conveyance path R1 extending leftward from a sheet receiving opening 13 of the post-processing apparatus 10 to a substantially transverse middle position of the post-processing apparatus 10; an auxiliary-tray conveyance path R2 branched off from the downstream end of the entrance conveyance path R1 and extending toward an auxiliary tray 15, a staple-unit conveyance path R3 branched off from the downstream end of the entrance conveyance path R1 and extending toward a post-processing space V1 of a staple unit 20, a main-tray conveyance path R4 extending toward a main tray 14 from the upper end of the post-processing space V1, a staple-tray conveyance path R5 branched off from the downstream end of the staple-unit conveyance path R3 and extending leftward toward a staple tray 30; a detour-tray conveyance path R6 branched off from the downstream end of the staple-unit conveyance path R3 and extending rightward; and a middle-folding-unit conveyance path R7 extending toward a middle-folding unit 17 through the detour tray 40. It should be noted that an end-binding stapler 38 for binding an end of a sheet stack P1 formed on the staple tray 30 is disposed at a position below the staple tray 30.

A switching guide 18 for switching a conveyance end of the sheet P between the auxiliary-tray conveyance path R2 and the staple-unit conveyance path R3 is disposed at the downstream end of the entrance conveyance path R1. If no binding is applied to the sheet P, the sheet P is discharged onto the auxiliary tray 15 via the auxiliary-tray conveyance path R2 with the switching guide 18 set in a specified posture. On the other hand, if binding is applied to the sheet P, the sheet P is fed to the staple unit 20 via the staple-unit conveyance path R3 by changing the posture of the switching guide 18. When a specified number of sheets P are stored in the post-processing space V1 to form a sheet stack P1, end binding is applied to this sheet stack P1 by the end-binding stapler 38. The stack of sheets P1 after the end binding is discharged onto the main tray 14 via the main-tray conveyance path R4.

The middle-folding-unit conveyance path R7 extends downward from a substantially vertical middle position of the detour tray 40. The sheet P to be folded in the middle is introduced into the middle-folding unit 17 via the middle-folding-unit conveyance path R7 after passing above the detour tray 40. A bottom part of such a middle-folding-unit conveyance path R7 is bent obliquely downward to the left toward the middle-folding unit 17 at the bottom end of the staple unit 20.

Figure 2:
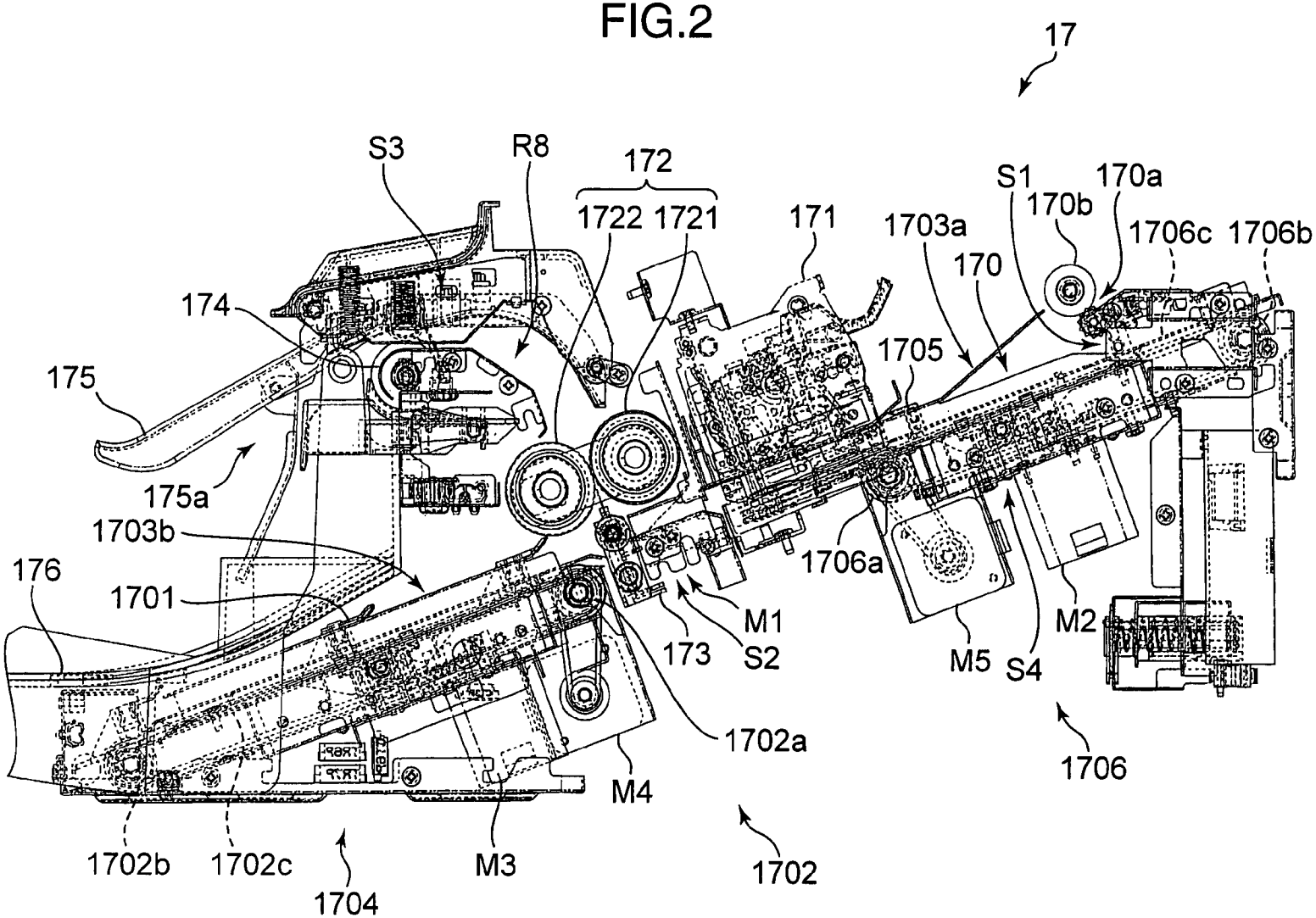
FIG. 2 is a front view in section enlargedly showing the middle-folding unit.
Figure 3:
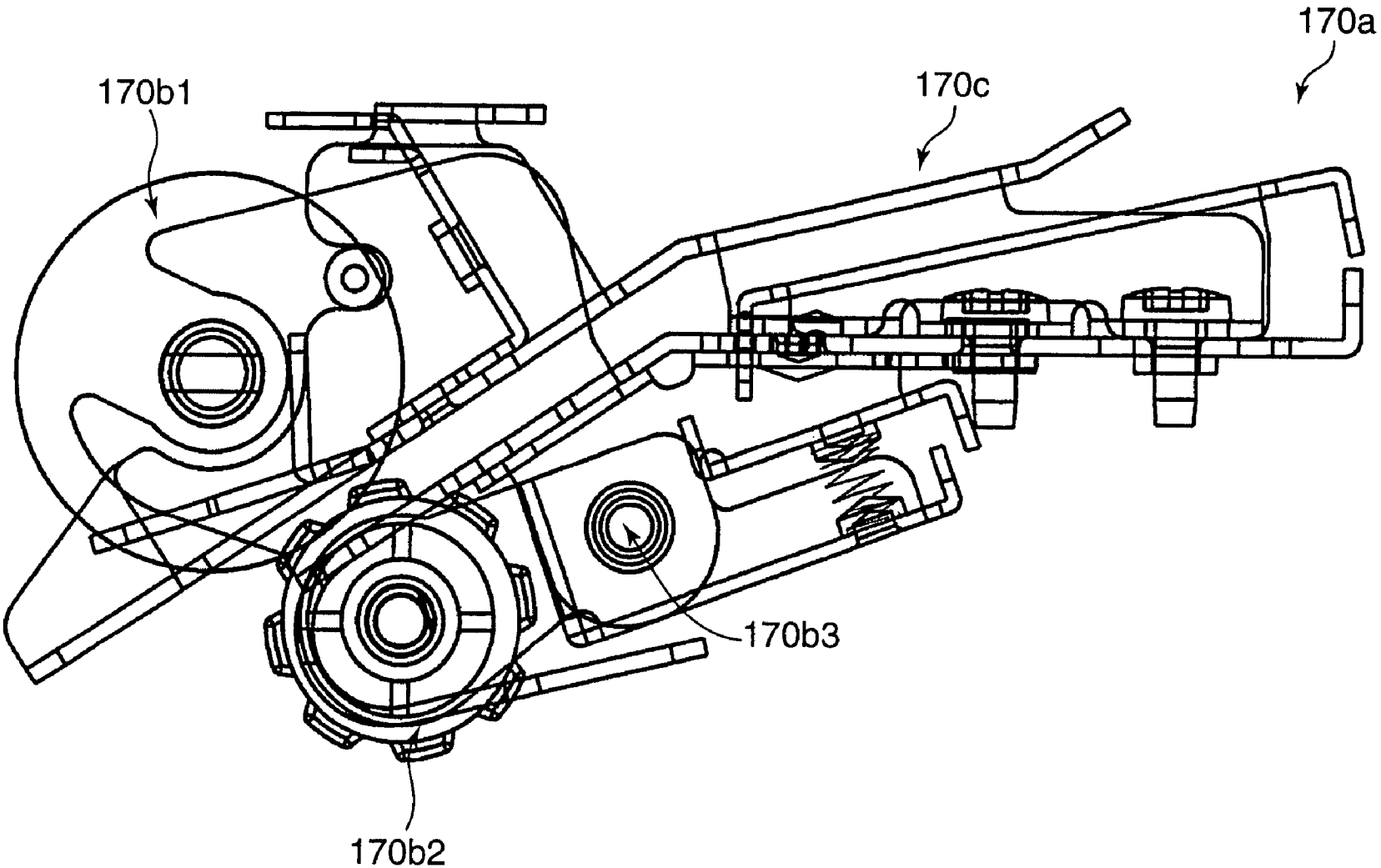
FIG. 3 is an enlarged section showing an essential portion of FIG. 2.
Figure 4:
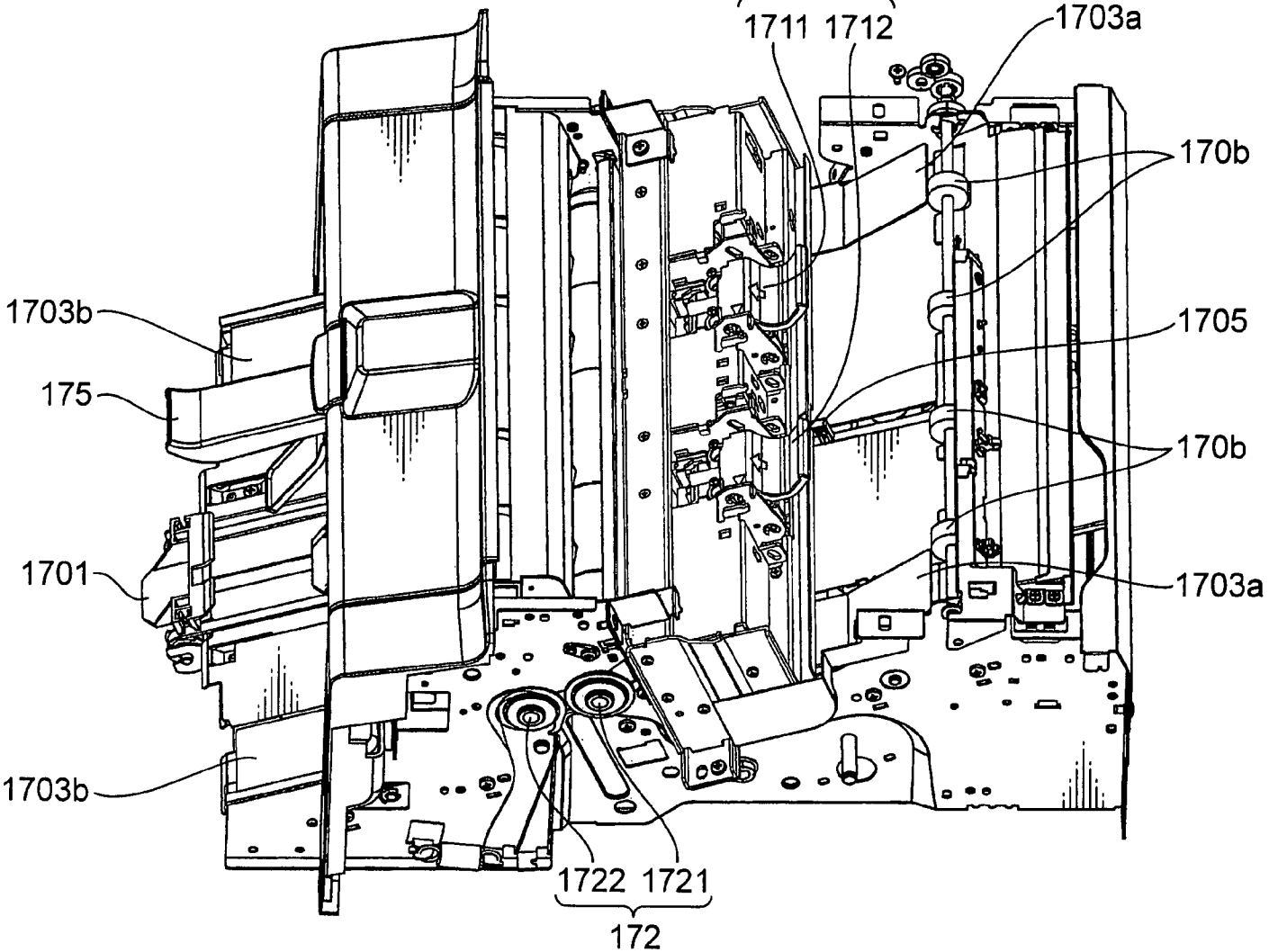
FIG. 4 is a perspective view enlargedly showing the external configuration of the middle-folding unit.

FIG. 2 is a front view in section enlargedly showing the middle-folding unit 17, FIG. 3 is an enlarged section showing an essential portion of FIG. 2, and FIG. 4 is a perspective view enlargedly showing the external configuration of the middle-folding unit 17. As shown in FIGS. 1, 2, 3 and 4, the middle-folding unit 17 as a sheet folding device is provided with a sheet placing table 170 connected with the middle-folding-unit conveyance path R7, a middle-binding stapler 171 disposed at an upper middle position of the sheet placing table 170, a pair of folding rollers 172 disposed at a position slightly downstream of the middle-binding stapler 171 and above the sheet placing table 170, a plate-shaped folding blade 173 opposed to the pair of folding rollers 172 below the sheet placing table 170 and crossing the sheet placing table 170, a carry-out roller 174 disposed downstream (upward) of the pair of folding rollers 172, and a pressing member 175 pivotally disposed about a specified axis.

The sheet placing table 170 is inclined downward toward the leading end with respect to a carry-in opening 170*a* for sheets P, and is at an angle of inclination of about 30° with respect to a horizontal plane so that a sheet P carried in by carry-in rollers 170*b* provided at the carry-in opening 170*a* smoothly slides along the outer surface of the sheet placing table 170. A pair of carry-in rollers 170*b* and a guide 170*c* are disposed at a position of the carry-in opening 170*a* as shown in FIG. 3. The pair of carry-in rollers 170*b* are comprised of a drive roller 170*b*1 driven by an unillustrated motor and a driven roller 170*b*2 driven to rotate by the drive roller 170*b*1, wherein the driven roller 170*b*2 is rotatable about a supporting point 170*b*3. By this rotation, the sheet can be carried onto the sheet placing table 170 with a constant force regardless of the thickness thereof. Further, the guide 170*c* is designed to guide the sheet P to a nip between the drive roller 170*b*1 and the driven roller 170*b*2, whereby the sheet P can be smoothly carried onto the sheet placing table 170. A shown in FIG. 2, a carry-in sensor S1 for detecting the sheet P being carried onto the sheet placing table 170 is arranged in the vicinity of the carry-in opening 170*a*. This carry-in sensor S1 is turned on upon detecting the leading end of the sheet P while being turned off after detecting the trailing end of the sheet P.

A sheet stacking mechanism according to one embodiment of the present invention is constructed by a front-aligning cursor 1701 for receiving the leading end of the sheet P carried onto the sheet placing table 170 and front-aligning-cursor moving means 1702 for moving the front-aligning cursor 1701 along the sheet placing table 170. The middle-folding unit 17 further includes upper width-aligning cursors 1703*a* and lower width-aligning cursors 1703*b* arranged at the opposite widthwise sides at upstream and downstream sides of the sheet placing table 170 with respect to a sheet conveying direction for aligning a sheet stack P2 comprised of a plurality of sheets P carried onto the sheet placing table 170 in width direction and correcting an oblique conveyance, and width-aligning cursor moving means 1704 for independently reciprocating both upper and lower width-aligning cursors 1703*a*, 1703*b* so that these cursors 1703*a*, 1703*b* are symmetrical on the sheet placing table 170 with respect to width direction. After being moved by the front-aligning-cursor moving means 1702 such that the sheet stack P2 comprised of a plurality of sheets P comes to such a position as to enable the middle binding by the middle-binding stapler 171 with the sheet stack P2 aligned with respect to width direction and its oblique conveyance corrected by the width-aligning cursor moving means 1704, the front-aligning cursor 1701 is moved such that the sheet stack P2 bound in the middle comes to such a position as to be folded in the middle by the pair of folding rollers 172 and the folding blade 173. It should be noted that a blade HP sensor S2 for detecting a home position (HP) of the folding blade 173 is arranged at a specified position of the folding blade 173 driven by a motor M1. This blade HP sensor S2 is turned on when the folding blade 173 comes to its home position.

The sheet placing table 170 also includes a back-aligning cursor 1705 for aligning the back end of the sheet stack P2 on the sheet placing table 170, and back-aligning-cursor moving means 1706 for moving the back-aligning cursor 1705 along the sheet placing table 170. An upper width-alignment HP sensor S4, a lower width-alignment HP sensor S5, a front-alignment HP sensor S6 and a back-alignment HP sensor S7 for detecting the respective home positions (HPs) of the upper width-aligning cursors 1703*a*, the lower width-aligning cursors 1703*b*, the front-aligning cursor 1701 and the front-aligning cursor 1705 are arranged at specified positions of the sheet placing table 170 (see FIG. 5). These upper width-alignment HP sensor S4, lower width-alignment HP sensor S5, front-alignment HP sensor S6 and back-alignment HP sensor S7 are turned on when the corresponding upper width-aligning cursors 1703*a*, lower width-aligning cursors 1703*b*, front-aligning cursor 1701 and back-aligning cursor 1705 come to their home positions.

A drive pulley 1702*a* to be driven by a motor M4 is arranged at the upper end of a downstream side of this sheet placing table 170, a driven pulley 1702*b* driven to rotate by the drive pulley 1702*a* is arranged at the bottom end of this downstream side, and an endless belt 1702*c* is so mounted between these pulleys 1702*a*, 1702*b* as to extend in the sheet conveying direction at the widthwise center of this downstream side. The front-aligning cursor 1701 having a Γ-shaped cross section is integrally formed at a specified position of the upper surface of the endless belt 1702*c*, and is moved along the sheet placing table 170 by a turning movement of the endless belt 1702*c*. The aforementioned front-aligning-cursor moving means 1702 is constructed by the motor M4, the pulleys 1702*a*, 1702*b*, the endless belt 1702*c* and a front-alignment instructing section 815 (see FIG. 5) to be described later.

Further, a drive pulley 1706*a* to be driven by a motor M5 is arranged at the bottom end of an upstream side of this sheet placing table 170, a driven pulley 1706*b* driven to rotate by the drive pulley 1706*a* is arranged at the upper end of this upstream side, and an endless belt 1706*c* is so mounted between these pulleys 1706*a*, 1706*b* as to extend in the sheet conveying direction at the widthwise center of this upstream side. The back-aligning cursor 1705 having a transversely inverted Γ-shaped cross section is integrally formed at a specified position of the upper surface of the endless belt 1706*c*, and is moved along the sheet placing table 170 by a turning movement of the endless belt 1706*c*. The aforementioned back-aligning-cursor moving means 1706 is constructed by the motor M5, the pulleys 1706*a*, 1706*b*, the endless belt 1706*c* and a back-alignment instructing section 816 (see FIG. 5) to be described later.

The upper width-aligning cursors 1703*a* include guiding plates having a Γ-shaped cross section and a transversely inverted Γ-shaped cross section when viewed from front and standing at the opposite widthwise sides of the endless belt 1706*c*. By cutting and bending parts of ceiling plates at the upper ends of these guiding plates, a sheet carried in from the carry-in rollers 170*b* can easily enter a space between the upper width-aligning cursors 1703*a*. The upper width-aligning cursors 1703*a* further include a pair of left and right racks (not shown) fixed to the guiding plates and supported movably along the width direction of the sheet placing table 170, pinions (not shown) in mesh with these racks, and a motor M2 for driving these pinions.

The lower width-aligning cursors 1703*b* include guiding plates having a Γ-shaped cross section and a transversely inverted Γ-shaped cross section when viewed from front and standing at the opposite widthwise sides of the endless belt 1702*c*. Unlike the upper width-aligning cursors 1703*a*, these guiding surfaces are entirely straight. The lower width-aligning cursors 1703*b* include a pair of left and right racks (not shown) fixed to the guiding plates and supported movably along the width direction of the sheet placing table 170, pinions (not shown) in mesh with these racks, and a motor M3 for driving these pinions.

The aforementioned width-aligning-cursor moving means 1704 is constructed by these motors M2, M3, racks and pinions and an upper and lower width-alignment instructing section 814 (see FIG. 5) and is capable of independently moving the upper width-aligning cursors 1703*a* and the lower width-aligning cursors 1703*b*.

The middle-binding stapler 171 is for applying so-called middle binding by driving staples at once to a middle part of the width-aligned sheet stack P2 of a specified number of sheets P with respect of the sheet conveying direction by means of a pair of left and right staplers 1711, 1712. Each of the staplers 1711, 1712 is provided at its lower part with a folding portion for enabling the staple driven from the front side and pierced through the sheet stack P2 to be easily folded back at the underside of the sheet stack P2.

The pair of folding rollers 172 are comprised of two folding rollers 1721, 1722 that are driven by an unillustrated motor while being synchronized with each other. One folding roller 1722 is elastically biased in a direction toward the other folding roller 1721 by an unillustrated spring so that the two rollers 1721, 1722 are pressed in contact at a nip with a specified force.

The folding blade 173 is constructed to press the middle part of the sheet stack P2 bound in the middle by the middle-biding stapler 171 toward a nip between the pair of folding rollers 172 by driving the motor M1. Accordingly, the sheet stack P2 folded in the middle by having the middle part thereof pressed by the folding blade 173 is pushed into a carry-out conveyance path R8 by the pair of folding rollers 172, and is discharged toward a middle-folded stack tray 176 via a discharge opening 175*a* comprised of the carry-out roller 174 and a pressing member 175. It should be noted that a discharge sensor S3 for detecting the sheet stack P2 discharged from the sheet placing table 170 is arranged in the vicinity of the carry-out opening 175*a*. This discharge sensor S3 is turned on upon detecting the sheet stack P2 discharged from the sheet placing table 170.

Figure 5:
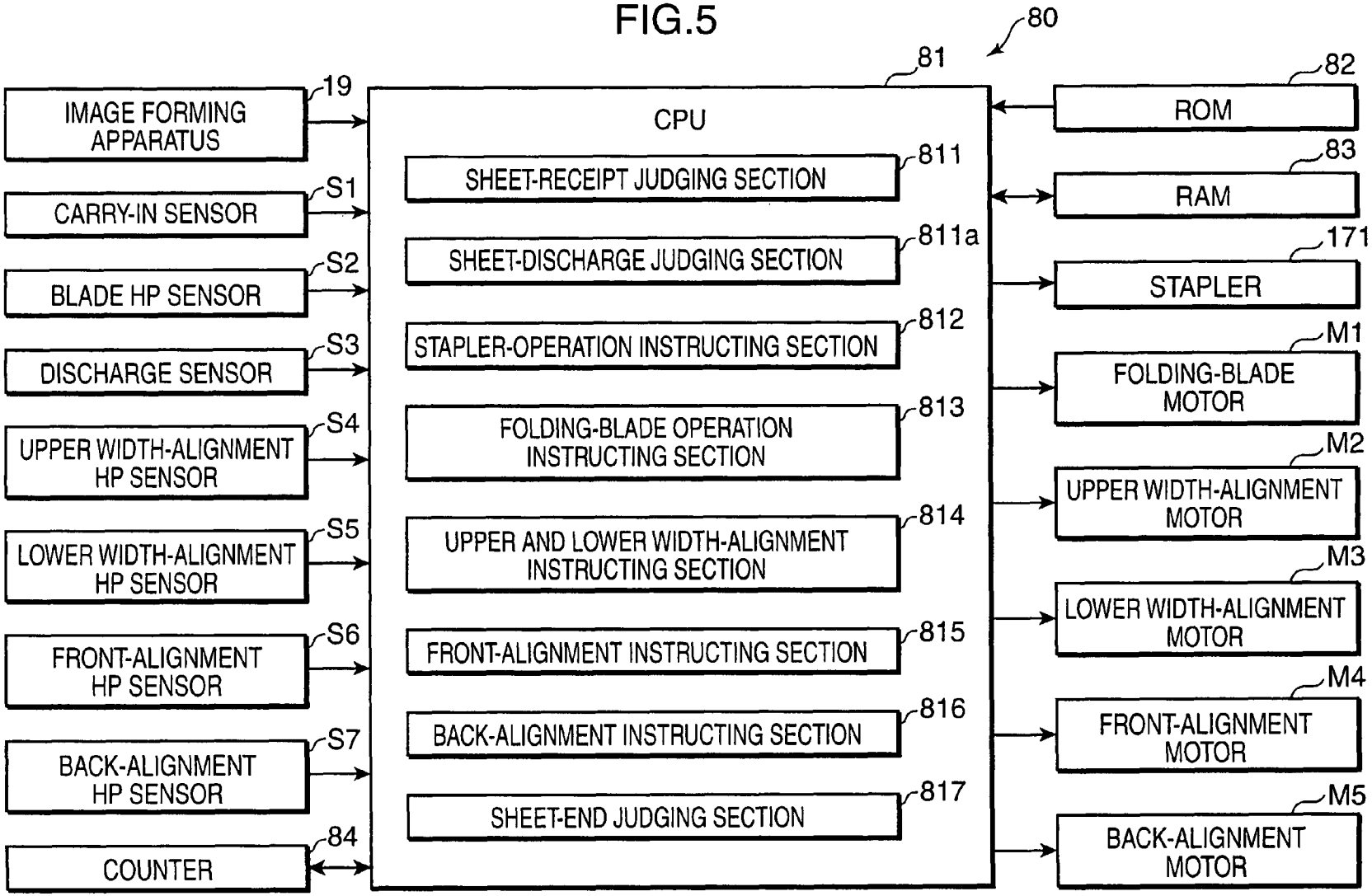
FIG. 5 is a functional block diagram of a control unit.

A control unit 80 including a microcomputer is provided for controlling the middle-folding process of the middle-folding unit 17. FIG. 5 is a functional block diagram of the control unit 80. As shown in FIG. 5, the control unit 80 has a basic construction provided with a CPU 81, a ROM 82 and a RAM 83 attached to this CPU 81, which is further electrically connected with a group of sensors S1 to S7, the middle-binding stapler 171 and a group of motors M1 to M5 that are, for example, stepping motors. A program for executing this control is stored in the ROM 82. Every time the sheet post-processing apparatus 10 is turned on, the program is read into the CPU 81. The RAM 83 is used to temporarily read and write data necessary for the control.

A sheet-receipt judging section 811, a sheet-discharge judging section 811*a*, a stapler-operation instructing section 812, a folding-blade-operation instructing section 813, the upper and lower width-alignment instructing section 814, the front-alignment instructing section 815, the back-alignment instructing section 816 and a sheet-end judging section 817 are built in the CPU 81 by the reading of the program. A counter 84 for counting the number of sheets P discharged to the conveyance path R7 during one job is disposed outside the CPU 81.

The sheet-receipt judging section 811 is for outputting specified signals to the stapler-operation instructing section 812, the folding-blade-operation instructing section 813, the upper and lower width-alignment instructing section 814, the front-alignment instructing section 815, and the back-alignment instructing section 816 every time a sheet P passes the sheet carry-in opening 170*a*. To this end, the sheet-receipt judging section 811 receives a detection signal (ON, OFF) for the sheet P from the carry-in sensor S1, judges a timing at which the sheet P is carried to the sheet placing table 170 via the carry-in rollers 170*b* by adding a period required for the conveyance of the sheet P to the carry-in rollers 170*b* to a timing represented by the received signal, and outputs signals representing the judged timing to the stapler-operation instructing section 812, the folding-blade-operation instructing section 813, the upper and lower width-alignment instructing section 814, the front-alignment instructing section 815, and the back-alignment instructing section 816.

The sheet-discharge judging section 811*a* is for outputting specified signals to the stapler-operation instructing section 812, the folding-blade-operation instructing section 813, the upper and lower width-alignment instructing section 814, the front-alignment instructing section 815, and the back-alignment instructing section 816 every time a sheet P passes the sheet discharge opening 175*a*. To this end, the sheet-discharge judging section 811*a* receives a detection signal (ON) for the sheet P from the discharge sensor S3, judges a timing at which the sheet P is discharged to the middle-folded stack tray 176 via the carry-out roller 174 by adding a period required for the conveyance of the sheet P to the carry-out roller 174 to a timing represented by the received signal, and outputs signals representing the judged timing to the stapler-operation instructing section 812, the folding-blade-operation instructing section 813, the upper and lower width-alignment instructing section 814, the front-alignment instructing section 815, and the back-alignment instructing section 816.

The stapler-operation instructing section 812 is for outputting a control signal to the middle-binding stapler 171 to apply the middle-binding operation the sheets after receiving the signal based on the judgment result of the sheet-receipt judging section 811 or the sheet-discharge judging section 811*a*. The signal based on the judgment result of the sheet-receipt judging section 811 or the sheet-discharge judging section 811*a* is outputted to the stapler-operation instructing section 812, which in turn outputs the control signal to the middle-binding stapler 171 to cause this stapler 171 to apply the middle-binding operation to the sheets.

The folding-blade-operation instructing section 813 is for outputting a control signal to the folding-blade motor M1 to move the folding blade 173 in a specified direction after receiving the signal based on the judgment result of the sheet-receipt judging section 811 or the sheet-discharge judging section 811*a*. The signal based on the judgment result of the sheet-receipt judging section 811 or the sheet-discharge judging section 811*a* is outputted to the folding-blade-operation instructing section 813, which in turn outputs the control signal to the folding-blade motor M1 to move the folding blade 173 in the specified direction.

The upper and lower width-alignment instructing section 814 is for outputting a control signal to the upper width-alignment motor M2 and the lower width-alignment motor M3 to move the upper and lower width-aligning cursors 1703*a*, 1703*b* in specified directions after receiving the signal based on the judgment result of the sheet-receipt judging section 811 or the sheet-discharge judging section 811*a*. The signal based on the judgment result of the sheet-receipt judging section 811 or the sheet-discharge judging section 811*a* is outputted to the upper and lower width-alignment instructing section 814, which in turn outputs the control signal to the upper width-alignment motor M2 and the lower width-alignment motor M3 to move the upper and lower width-aligning cursors 1703*a*, 1703*b* in the specified directions.

The front-alignment instructing section 815 is for outputting a control signal to the front-alignment motor M4 to move the front-aligning cursor 1701 in a specified direction after receiving the signal based on the judgment result of the sheet-receipt judging section 811 or the sheet-discharge judging section 811*a*. The signal based on the judgment result of the sheet-receipt judging section 811 or the sheet-discharge judging section 811*a* is outputted to the front-alignment instructing section 815, which in turn outputs the control signal to the front-alignment motor M4 to move the front-aligning cursor 1701 in the specified direction.

By this front-alignment instructing section 815, there is realized an operation control unit for: (1) receiving the leading end of the sheet P carried in from the carry-in opening 170*a* by the front-aligning cursor 1701 moved to a first position within a specified range, and (2) moving the front-aligning cursor 1701 until the trailing end of the received sheet P slips under the guide 170*c* for the pair of carry-in rollers 170*b* constructing the carry-in opening 170*a* to move the trailing end of this sheet P away from the leading end of the a sheet P carried in next.

The back-alignment instructing section 816 is for outputting a control signal to the back-alignment motor M5 to move the back-aligning cursor 1705 in a specified direction after receiving the signal based on the judgment result of the sheet-receipt judging section 811 or the sheet-discharge judging section 811*a*. The signal based on the judgment result of the sheet-receipt judging section 811 or the sheet-discharge judging section 811*a* is outputted to the back-alignment instructing section 816, which in turn outputs the control signal to the back-alignment motor M5 to move the back-aligning cursor 1705 in the specified direction.

The counter 84 is configured to count the number of sheets P every time the sheet-receipt judging section 811 judges the receipt of a sheet P and to input the number of sheets discharged from the image forming apparatus 19 to the sheet post-processing apparatus 10 to the CPU 81.

The sheet-end judging section 817 judges whether or not the number of sheets counted by the counter 84 coincides with sheet number information from the image forming apparatus 19, and outputs signals based on the judgment result to the stapler-operation instructing section 812, the folding-blade-operation instructing section 813, the upper and lower width-alignment instructing section 814, the front-alignment instructing section 815, and the back-alignment instructing section 816 when the counted number of sheets coincides with the sheet number information. The stapler-operation instructing section 812, the folding-blade-operation instructing section 813, the upper and lower width-alignment instructing section 814, the front-alignment instructing section 815, and the back-alignment instructing section 816 having received these signals output signals to the middle-binding stapler 171, the folding-blade motor M1, the upper width-alignment motor M2, the lower width-alignment motor M3, the front-aligning cursor 1701, and the back-aligning cursor 1705 to cause them to stop operating. In this way, the respective operations of the middle-binding stapler 171, the folding-blade motor M1, the upper width-alignment motor M2, the lower width-alignment motor M3, the front-aligning cursor 1701, and the back-aligning cursor 1705 are stopped.

Figure 6:
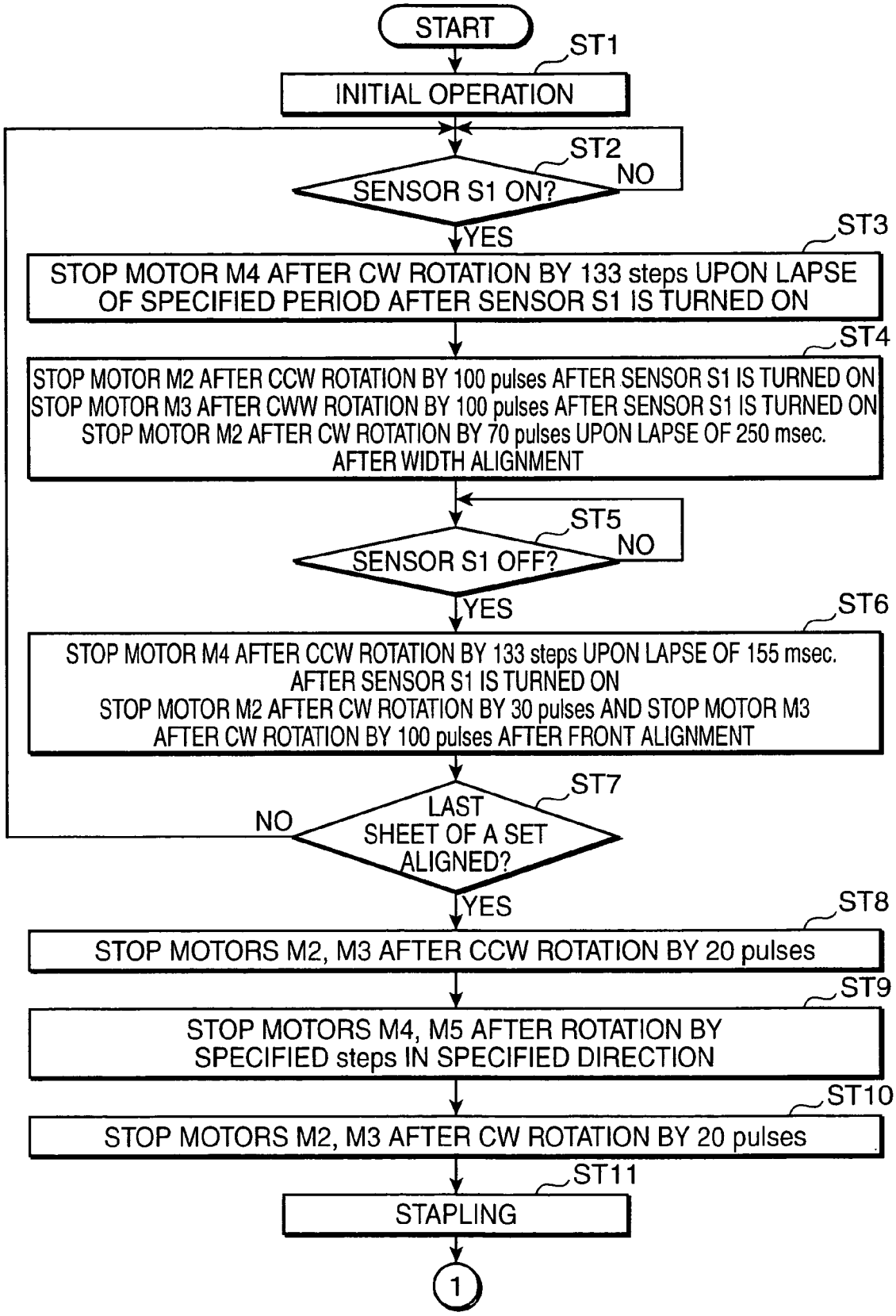
FIG. 6 is a flow chart showing an operation of the middle-folding unit (front part).
Figure 7:
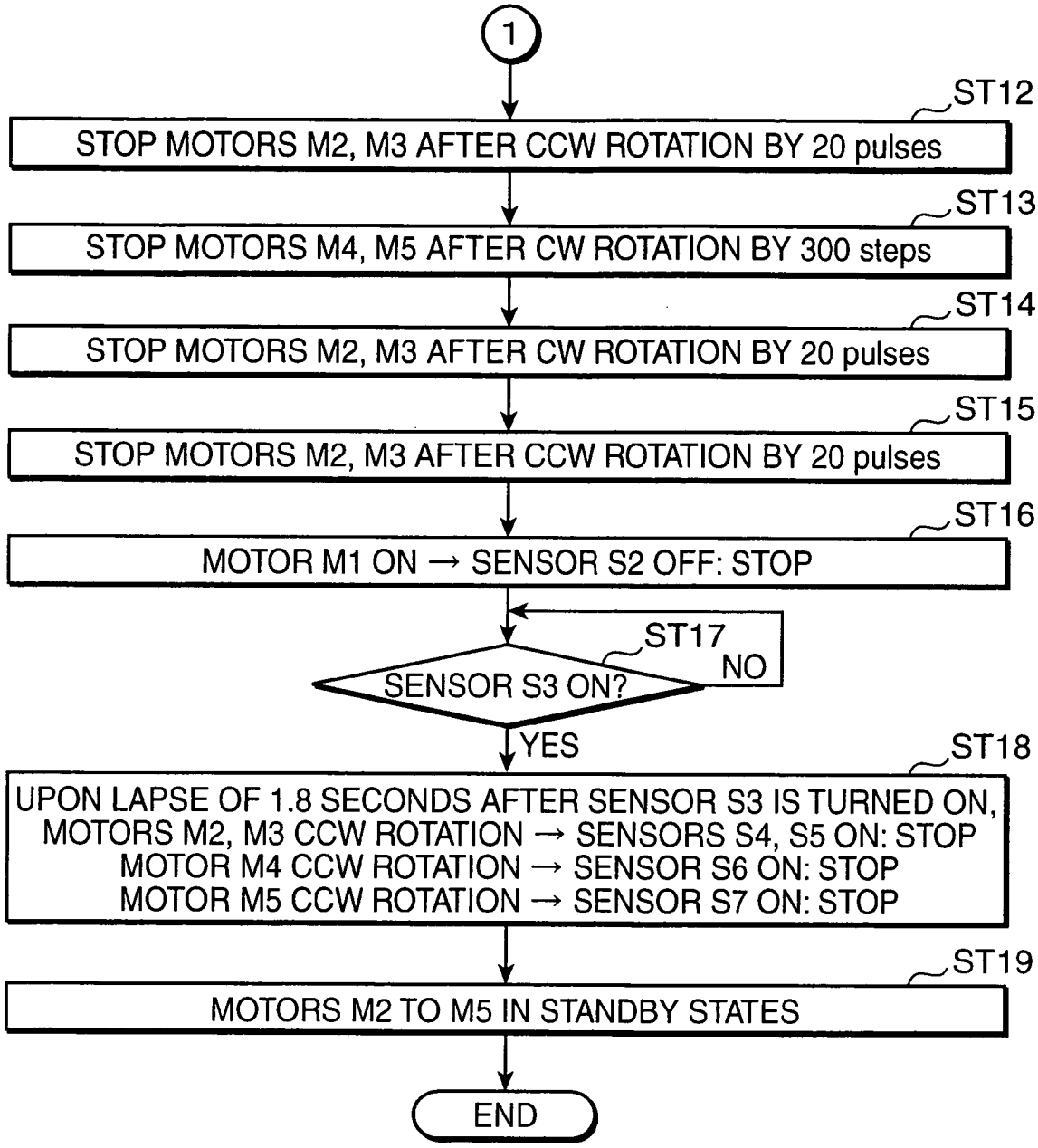
FIG. 7 is a flow chart showing the operation of the middle-folding unit (rear part).

Next, the middle-folding operation by the middle-folding unit 17 of the sheet post-processing apparatus 10 is described. FIGS. 6 and 7 are a flow chart showing the operation of the middle-folding unit 17 and FIGS. 8A to 8D are diagrams showing the operation of the middle-folding unit 17.

In FIG. 6, a specified initial operation is carried out when the apparatus 10 is turned on (Step ST1). In this initial operation, the respective members are set at the respective home positions. Specifically, the upper and lower width-alignment motors M2, M3 are rotated in specified directions by specified numbers of steps by an instruction from the upper and lower width-alignment instructing section 814 of the control unit 80 of FIG. 4, and stopped when the upper and lower width-alignment HP sensors S4, S5 are turned on. The front-alignment motor M4 is rotated in a specified direction by a specified number of steps by an instruction from the front-alignment instructing section 815, and stopped when the front-alignment HP sensor S6 is turned on. The back-alignment motor M5 is rotated in a specified direction by a specified number of steps by an instruction from the back-alignment instructing section 816, and stopped when the back-alignment HP sensor S7 is turned on.

Subsequently, the sheet-receipt judging section 811 judges whether or not the carry-in sensor S1 has been turned on and this routine waits on standby until the carry-in sensor S1 is judged to have been turned on (Step S2). Upon the lapse of a specified period after the sheet-receipt judging section 811 judges that the carry-in sensor S1 has been turned on, the front-alignment motor M4 is rotated clockwise (CW) by 133 steps by an instruction from the front-alignment instructing operation 815 (Step ST3). Then, the front-aligning cursor 1701 moves downward by 26.6 mm from the home position on the sheet placing table 170 (i.e. the front-aligning cursor 1701 is moved to the first position).

Further, immediately after the sheet-receipt judging section 811 judges that the carry-in sensor S1 has been turned on, the upper width-alignment motor M2 is stopped after being rotated counterclockwise (CCW) by 100 pulses and the lower width-alignment motor M3 is stopped after being rotated counterclockwise by 100 pulses by an instruction from the upper and lower width-alignment instructing section 814. Then, the upper and lower width-aligning cursors 1703*a*, 1703*b* are each moved toward the opposite widthwise ends by 10 mm on the sheet placing table 170. At this time, the back-aligning cursor 1705 is still kept at its home position so as not to hinder the conveyance of the sheet P, and the sheet P is carried onto the sheet placing table 170 by the carry-in rollers 170*b* and slides down on the upper surface of the sheet placing table 170 by the action of gravity.

Upon the lapse of 250 msec. after this width alignment (the sheet P is still sliding down by the action of gravity), the upper width-alignment motor M2 is stopped after being rotated clockwise by 70 pulses by an instruction from the upper and lower width-alignment instructing section 814 (Step ST4). Then, the upper width-aligning cursors 1703*a* are each moved toward the widthwise center by 7 mm at both sides. At this time, the leading end of the sheet substantially has the width thereof aligned by the upper width-aligning cursors 1703*a* and has its oblique conveyance corrected.

Subsequently, the sheet-receipt judging section 811 judges whether or not the carry-in sensor S1 has been turned off and this routine waits on standby until the carry-in sensor S1 is judged to have been turned off (Step ST5).

Figure 8A:
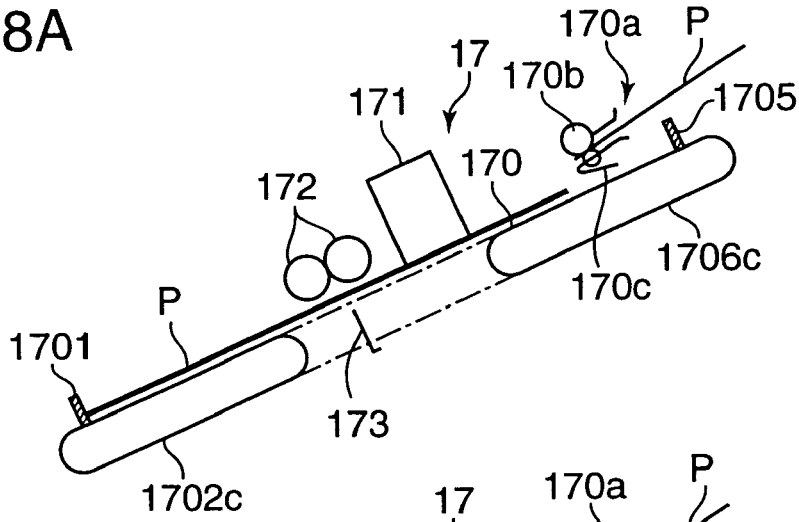
FIGS. 8A to 8D are diagrams showing an exemplary operation of the middle-folding unit.
Figure 8B:
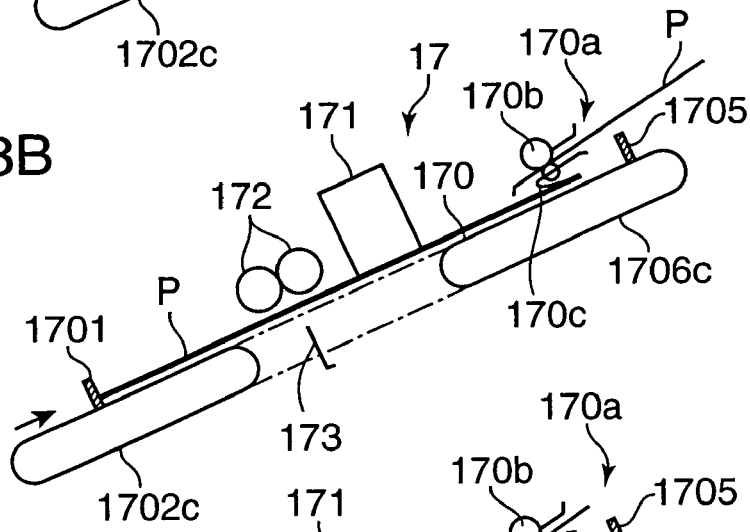
Figure 8C:
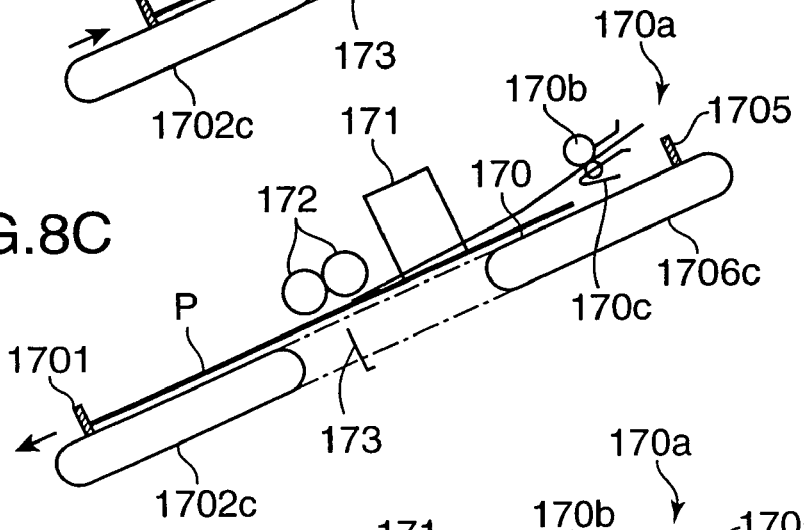

Upon the lapse of 155 msec. after the sheet-receipt judging section 811 judges that the carry-in sensor S1 has been turned off (when one sheet P is completely carried onto the sheet placing table 170: see FIG. 8A), the front-alignment motor M4 is stopped after being rotated counterclockwise by 133 steps by an instruction from the front-alignment instructing section 815. Then, the front-aligning cursor 1701 is moved upward by 26.6 mm on the sheet placing table 170, i.e. to a second position. This movement brings the sheet P upward lest the leading end of a next sheet should interfere with the trailing end of the immediately preceding sheet (see FIG. 8B). In other words, since the trailing end of one sheet P slips under the guide 170*c* by the movement of this sheet P, there is no likelihood that the leading end of the next sheet causes a jam or the like by coming into contact with the trailing end of the preceding sheet.

After this front alignment, the upper width-alignment motor M2 is stopped after being rotated clockwise by 30 pulses and the lower width-alignment motor M3 is stopped after being rotated clockwise by 100 pulses by an instruction from the upper and lower wais 814 (Step ST6). Then, the upper width-aligning cursors 1703*a* are each moved toward the widthwise center by 3 mm at both sides and the lower width-aligning cursors 1703*b* are each moved toward the widthwise center by 10 mm at both sides. At this time, the sheet P is precisely aligned with respect to width direction by both upper and lower width-aligning cursors 1703*a* and 1703*b* and has its oblique conveyance corrected.

Subsequently, the sheet-end judging section 817 judges whether or not the alignment (width alignment and oblique conveyance correction) of the last sheet of a set has been completed (Step ST7). Here, if the sheet-end judging section 817 judges that the alignment of the last sheet has not been completed, this routine returns to Step ST2 to repeat Steps ST2 to ST6.

Specifically, the sheet-receipt judging section 811 judges whether or not the carry-in sensor S1 has been turned on and this routine waits on standby until the carry-in sensor S1 is judged to have been turned on (Step ST2). Upon the lapse of a specified period after the sheet-receipt judging section 811 judges that the carry-in sensor S1 has been turned on, the front-alignment motor M4 is stopped after being rotated clockwise (CW) by 133 steps by an instruction form the front-alignment instructing section 815 (Step ST3). Then, the front-aligning cursor 1701 is moved downward by 26.6 mm on the sheet placing table 170 (see FIG. 8C). In other words, the front-aligning cursor 1701 is moved to the first position.

Further, immediately after the sheet-receipt judging section 811 judges that the carry-in sensor S1 has been turned on, the upper width-alignment motor M2 is stopped after being rotated counterclockwise (CCW) by 100 pulses and the lower width-alignment motor M3 is stopped after being rotated counterclockwise by 100 pulses by an instruction from the upper and lower width-alignment instructing section 814. Then, both upper and lower width-aligning cursors 1703*a*, 1703*b* are each moved toward the widthwise ends by 10 mm on the sheet placing table 170. At this time, the back-aligning cursor 1705 is still kept at its home position so as not to hinder the conveyance of the sheet P, and the sheet P is carried onto the sheet placing table 170 by the carry-in rollers 170*b* and slides down on the upper surface of the sheet placing table 170 by the action of gravity.

Upon the lapse of 250 msec. after this width alignment (the sheet P is still sliding down by the action of gravity), the upper width-alignment motor M2 is stopped after being rotated clockwise by 70 pulses by an instruction from the upper and lower width-alignment instructing section 814 (Step ST4). Then, the upper width-aligning cursors 1703*a* are each moved toward the widthwise center by 7 mm at both sides. At this time, the leading end of the sheet substantially has the width thereof aligned by the upper width-aligning cursors 1703*a* and has its oblique conveyance corrected.

Subsequently, the sheet-receipt judging section 811 judges whether or not the carry-in sensor S1 has been turned off and this routine waits on standby until the carry-in sensor S1 is judged to have been turned off (Step ST5).

Figure 8D:
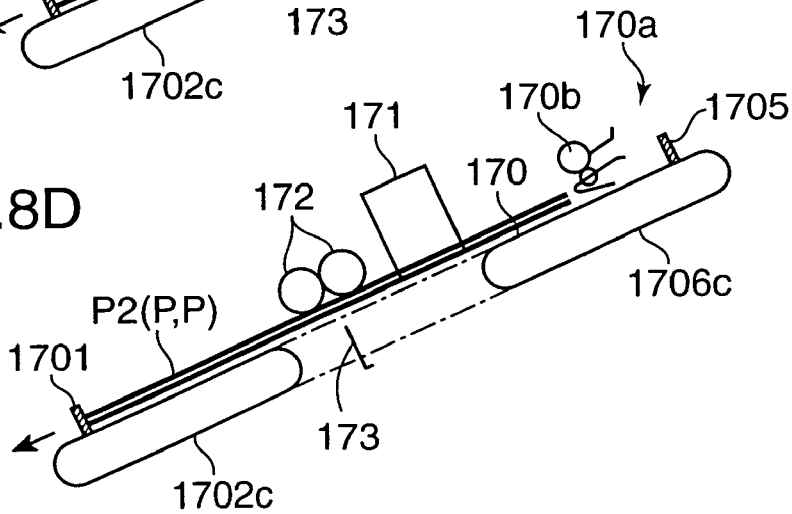

Upon the lapse of 155 msec. after the sheet-receipt judging section 811 judges that the carry-in sensor S1 has been turned off (when the two sheets P are completely carried onto the sheet placing table 170: see FIG. 8D), the front-alignment motor M4 is stopped after being rotated counterclockwise by 133 steps by an instruction from the front-alignment instructing section 815 (Step ST6). Then, the front-aligning cursor 1701 is moved upward by 26.6 mm on the sheet placing table 170, i.e. to a second position. This movement brings the two sheets P upward lest the leading end of a next sheet should interfere with the trailing ends of the preceding sheets. In other words, since the trailing ends of the two sheets P slip under the guide 170*c* by the movement of the two sheets P, there is no likelihood that the leading end of the next sheet causes a jam or the like by coming into contact with the trailing ends of the preceding sheets. By repeating the above operation, a specified number of sheets P are stacked and, thereafter, processings such as middle binding are applied to each sheet stack P2.

When the sheet-end judging section 817 judges that the alignment of the last sheet of the set has been completed (YES in Step ST7), next Step ST8 follows. Here, the upper and lower width-alignment motors M2, M3 are respectively stopped after being rotated counterclockwise by 20 pulses by an instruction from the upper and lower width-alignment instructing section 814 (Step ST8). Then, the upper and lower width-aligning cursors 1703*a*, 1703*b* are each moved toward the opposite widthwise ends by 2 mm. Since this makes the sheets between the upper and lower width-aligning cursors 1703*a*, 1703*b* movable, the front-alignment motor M4 and back-alignment motor M5 are respectively stopped after being rotated in specified directions by specified numbers of steps by instructions from the front-alignment instructing section 815 and the back-alignment instructing section 816 (Step ST9). In this way, the sheets can be easily located at a specified middle-binding position.

Further, the upper and lower width-alignment motors M2, M3 are respectively stopped after being rotated clockwise by 20 pulses by an instruction from the upper and lower width-alignment instructing section 814 (Step ST10). Then, the upper and lower width-aligning cursors 1703*a*, 1703*b* are each moved toward the widthwise center by 2 mm to fix the sheets. A specified middle-binding processing is applied by the middle-binding stapler 171 by an instruction from the stapler-operation instructing section 812 (Step ST11).

Subsequently, in FIG. 7, the upper and lower width-alignment motors M2, M3 are respectively stopped after being rotated counterclockwise by an instruction from the upper and lower width-alignment instructing section 814 (Step ST12). Then, the upper and lower width-aligning cursors 1703*a*, 1703*b* are moved toward the opposite widthwise ends by 2 mm. Since this makes the sheets P between the upper and lower width-aligning cursors 1703, 1703*b* movable, the front-alignment motor M4 is stopped after being rotated clockwise by 300 steps by an instruction from the front-alignment instructing section 815 and the back-alignment motor M5 is stopped after being rotated clockwise by 300 steps by an instruction from the back-alignment instructing section 816 (Step ST13). Then, the back-aligning cursor 1705 is moved downward along the sheet placing table by 60 mm, and the front-aligning cursor 1701 is moved downward along the sheet placing table 170 by 60 mm. In this way, the sheet stack P2 tightly held between these cursors 1701, 1705 can be easily located at such a position where the sheet stack P2 can be folded in the middle by the pair of folding rollers 172 and the folding blade 173.

Subsequently, the upper and lower width-alignment motors M2, M3 are respectively stopped after being rotated clockwise by 20 pulses by an instruction from the upper and lower width-alignment instructing section 814 (Step ST14). Then, the upper and lower width-aligning cursors 1703*a*, 1703*b* are each moved toward the widthwise center by 2 mm at both sides. In this way, the sheet stack P2 is aligned with respect to width direction and has its oblique conveyance corrected.

Further, the upper and lower width-alignment motors M2, M3 are each stopped after being rotated counterclockwise by 20 pulses by an instruction from the upper and lower width-alignment instructing section 814 (Step ST15). Then, the upper and lower width-aligning cursors 1703*a*, 1703*b* are moved toward the opposite widthwise sides by 2 mm, thereby making the sheet stack P2 movable and enabling the middle folding process.

Subsequently, the folding-blade motor M1 is turned on by an instruction from the folding-blade operation instructing section 813 (Step ST16). Then, the folding blade 173 pushes the middle part of the sheet stack P2 toward the nip of the pair of folding rollers 172, wherefore the sheet stack P2 sandwiched between the folding rollers 172 is folded in two. The sheet stack P2 is discharged through between the folding rollers 172, whereas the folding blade 173 is returned to its initial position and the folding-blade motor M1 is stopped when the folding-blade HP sensor S2 is turned off.

Subsequently, the sheet-discharge judging section 811*a* judges whether or not the discharge sensor S3 has been turned on and this routine waits on standby until the discharge sensor S3 is judged to have been turned on (Step ST17). Upon the lapse of 1.8 sec. after the sheet-discharge judging section 811*a* judges that the discharge sensor S3 has been turned on, the upper and lower width-alignment motors M2, M3 are respectively rotated counterclockwise by an instruction from the upper and lower width-alignment instructing section 814 and stopped when the upper and lower width-alignment HP sensors S4, S5 are respectively turned on. Further, the front-alignment motor M4 is rotated counterclockwise by an instruction from the front-alignment instructing section 815 and stopped when the front-alignment HP sensor S6 is turned on. Furthermore, the back-alignment motor M5 is rotated counterclockwise by an instruction from the back-alignment instructing section 816 and stopped when the back-alignment HP sensor S7 is turned on (Step ST18).

In this way, the upper and lower width-alignment motors M2, M3, the front-alignment motor M4 and the back-alignment motor M5 are all brought to standby states and a job is ended (Step ST19).

As described in detail above, the middle-folding unit of the sheet post-processing apparatus 10 according to one embodiment of the present invention is provided with the front-aligning cursor 1701 disposed movably along the upper surface of the sheet placing table 170 within the specified range including the first position set at a position displaced from the carry-in opening 170*a* toward the other end of the sheet placing table 170 at least by the length of the sheet P, and the control unit 80, wherein the front-alignment instructing section 815 causes the front-aligning cursor 1701 to move to the first position and to receive the leading end of the sheet P carried in from the carry-in opening 170*a*, and causes the front-aligning cursor 1701 to move until the trailing end of the received sheet P slips under the carry-in opening 170*a*, bringing the trailing end of the sheet P away from the leading end of a sheet carried in next. Thus, even if the sheet P is stacked in an unstable state such as in a curled state, there is no problem such as the switch of sheets (disorder in numbering) caused by a succeeding sheet having slipped in a clearance between the sheets or the sheet and the sheet placing table 170, for example, due to a curled state of the sheet and an occurrence of a jam caused by the collision of sheets. Further, since no paddle is used to prevent the switch of the sheets P, there is no problem of loud hitting sounds (noise) of the paddle. As a result, it is possible to prevent a disorder in the numbering of stacked sheets without creating any noise and to securely prevent an occurrence of a conveyance jam by a collision.

Although the middle-binding stapler 171 is incorporated into the middle-folding unit 17 in the foregoing embodiment, it is not always necessary to incorporate this middle-binding stapler into the middle-folding unit 17. In such a case, the middle-binding stapler 171 may be incorporated, for example, into the staple tray 30 upstream of the sheet post-processing apparatus 10.

Although the sheet stacking mechanism of the middle-folding unit 17 built in the sheet post-processing apparatus 10 connected with the image forming apparatus 19 is described in the foregoing embodiment, the sheet stacking mechanism according to the embodiment of the present invention is similarly applicable to sheet stacking mechanisms provided in other apparatuses.

In short, the present invention is directed to a sheet stacking mechanism comprising a sheet placing table having one end of the upper surface thereof arranged at the side of a carry-in opening for sheets and having sheets carried in from the carry-in opening successively stacked on the upper surface thereof; a receiving member disposed movably along the upper surface of the sheet placing table within a specified range including a first position located at the other end of the sheet placing table and distanced from the carry-in opening at least by the length of the sheet on the sheet placing table and adapted to receive the leading end of the sheet on the sheet placing table; and an operation control unit for performing a control of moving the receiving member to the first position and a control of moving the receiving member to a second position where the trailing end of the sheet slips under the carry-in opening.

In the present invention, the operation control unit causes the receiving member to move from the second position to the first position upon the lapse of a predetermined period after the leading end of a succeeding sheet is carried onto the sheet placing table from the carry-in opening.

In the present invention, a carry-in sensor for detecting the sheet being carried onto the sheet placing table is disposed in the vicinity of the carry-in opening, and the operation control unit causes the receiving member to move to the first position upon the lapse of a predetermined period after the sheet is detected by the carry-in sensor while causing the receiving member to move to the second position after the sheet is no longer detected by the carry-in sensor.

In the present invention, the operation control unit causes the receiving member to move to the first position upon the lapse of a predetermined period after the leading end of the sheet is carried onto the sheet placing table from the carry-in opening while causing the receiving member to move to the second position after the trailing end of the sheet is carried onto the sheet placing table.

In the present invention, a pair of carry-in rollers disposed at the carry-in opening for carrying sheets onto the sheet placing table and a guide for guiding sheets to the pair of carry-in rollers are further provided, and the one end of the sheet placing table is extended to a position below the guide so that the trailing end of the sheet having slipped under the carry-in opening is/are placed thereon.

According to these inventions, the receiving member for receiving the leading end of the sheet on the sheet placing table is disposed movably along the upper surface of the sheet placing table within the specified range including the first position located at the other end of the sheet placing table and distanced from the carry-in opening at least by the length of the sheet on the sheet placing table, and the operation control unit causes the receiving member to move to the second position where the trailing end of the sheet received by the receiving member slips under the carry-in opening. Thus, even if the sheets are stacked in an unstable state such as in a curled state, the leading end of a succeeding sheet carried onto the sheet placing table from the carry-in opening can be located on the sheets already stacked on the sheet placing table. Therefore, there is no problem such as the switch of sheets (disorder in numbering) caused by a succeeding sheet having slipped in a clearance between the sheets or the sheet and the sheet placing table, for example, due to a curled state of the sheet and an occurrence of a jam caused by the collision of sheets.

Further, since no paddle is used to prevent the switch of the sheets, there is no problem of loud hitting sounds (noise) of the paddle. As a result, it is possible to prevent a disorder in the numbering of stacked sheets without creating any noise and to securely prevent an occurrence of a conveyance jam by a collision.

In the present invention, the sheet placing table has such an inclination that the one end thereof is located higher than the other end thereof.

With this arrangement, the sheets can be more smoothly carried onto the sheet placing table.

The present invention is also directed to a sheet folding device comprising the sheet stacking mechanism according to the present invention and a middle-folding device for applying a middle-binding process and a middle-folding process to a sheet stack comprised of a plurality of sheets stacked on the sheet placing table at a position near a middle part of the sheet placing table with respect to a sheet conveying direction.

With such a sheet folding device, there is no problem such as the switch of sheets (disorder in numbering) caused by a succeeding sheet having slipped in a clearance between the sheets or the sheet and the sheet placing table, for example, due to a curled state of the sheet and an occurrence of a jam caused by the collision of sheets. Therefore, the middle-binding and middle-folding processes can be satisfactorily performed.

The present invention is further directed to a sheet post-processing apparatus comprising the sheet folding device according to the present invention in an apparatus main body connected with an image forming apparatus, wherein sheets having images formed thereon in the image forming apparatus are carried onto the sheet placing table.

The present invention is furthermore directed to an image forming apparatus comprising any one of the sheet stacking mechanism, the sheet folding device and the sheet post-processing apparatus according to the present invention.

This application is based on patent application No. 2005-345706 filed on Nov. 30, 2005 in Japan, the contents of which are hereby incorporated by references.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds are therefore intended to embraced by the claims.

What is claimed is:

1. A sheet stacking mechanism, comprising:

a sheet placing table having one end of the upper surface thereof arranged at the side of a carry-in opening for sheets and having sheets carried in from the carry-in opening successively stacked on the upper surface thereof;

a receiving member disposed movably along the upper surface of the sheet placing table within a specified range including a first position located at the other end of the sheet placing table and distanced from the carry-in opening at least by the length of the sheet on the sheet placing table and adapted to receive the leading end of the sheet on the sheet placing table; and an operation control means for performing a control of moving the receiving member for each of the sheets successively carried in through the carry-in opening from a second position where the trailing end of the sheet that previously was received by the receiving member on the sheet placing table slips under the carry-in opening to the first position upon the lapse of a predetermined period after the leading end of each successive one of the sheets is carried onto the sheet placing table from the carry-in opening, and a control of moving the receiving member from the first position to the second position after the trailing end of each successive one of the sheets is carried onto the sheet placing table from the carry-in opening.

2. A sheet stacking mechanism according to claim 1, further comprising a carry-in sensor disposed in the vicinity of the carry-in opening for detecting a sheet to be carried onto the sheet placing table, wherein the operation control unit causes the receiving member to move to the first position upon the lapse of a predetermined period after the sheet is detected by the carry-in sensor while causing the receiving member to move to the second position after the sheet is no longer detected by the carry-in sensor.

3. An image forming apparatus, comprising the sheet stacking mechanism according to claim 2.

4. A sheet stacking mechanism according to claim 1, wherein the sheet placing table has such an inclination that the one end closer to the sheet carry-in opening is located higher than the other end at which the receiving member is provided.

5. A sheet stacking mechanism according to claim 1, further comprising a pair of carry-in rollers disposed at the carry-in opening for carrying a sheet onto the sheet placing table and a guide for guiding the sheet to the pair of carry-in rollers, wherein the one end of the sheet placing table is extended to a position below the guide so that the trailing end of the sheet having slipped under the carry-in opening is placed thereon.

6. A sheet folding device, comprising the sheet stacking mechanism according to claim 1, and a middle-folding device for applying a middle-binding process and a middle-folding process to a sheet stack comprised of a plurality of sheets stacked on the sheet placing table at a position near a middle part of the sheet placing table with respect to a sheet conveying direction.

7. A sheet post-processing apparatus, comprising the sheet folding device according to claim 6 in an apparatus main body connected with an image forming apparatus, wherein sheets having image formed thereon in the image forming apparatus are carried onto the sheet placing table.

8. An image forming apparatus, comprising the sheet post-processing apparatus according to claim 7.

9. An image forming apparatus, comprising the sheet folding device according to claim 6.

10. An image forming apparatus, comprising the sheet stacking mechanism according to claim 1.

11. A sheet stacking mechanism for sequentially stacking a plurality of sheets, each of said sheets having a leading end and a trailing end defining a length for the sheet, the sheet stacking mechanism comprising:

a sheet placing table having opposite first and second ends and an upper surface extending between the ends;

a carry-in opening disposed above the upper surface of the sheet placing table and aligned with a position of the sheet placing table between the first and second ends thereof;

a receiving member movably disposed adjacent the upper surface of the sheet placing table between a first position spaced from the carry-in opening by a distance at least as great as the length of the sheet and a second position spaced from the carry-in opening less than the length of the sheet; and operation control means for controlling movement of the receiving member for each of the sequentially stacked sheets from the second position to the first position upon a lapse of a predetermined period after the leading end of each of the respective sheets is carried sequentially onto the sheet placing table from the carry-in opening and for controlling movement of the receiving member from the first position to the second position after the trailing end of each of the respective sheets is carried sequentially onto the sheet placing table from the carry-in opening.

12. A sheet stacking mechanism according to claim 11, further comprising a carry-in sensor disposed in proximity to the carry-in opening for detecting a sheet to be carried onto the sheet placing table, wherein the operation control unit causes the receiving member to move to the first position upon the lapse of a predetermined period after the sheet is detected by the carry-in sensor while causing the receiving member to move to the second position after the sheet is no longer detected by the carry-in sensor.

13. A sheet stacking mechanism according to claim 11, further comprising a guide adjacent the carry-in opening, the guide being sloped relative to the upper surface of the sheet placing table so that an end of the guide closer to the first end of the sheet placing table is spaced farther from the upper surface of the sheet placing table than an end of the guide farther from the first end of the sheet placing table, whereby the trailing end of the sheet on the sheet placing table slips under the guide as the receiving member is moved from the first position to the second position.

14. A sheet stacking mechanism according to claim 13, wherein the carry-in opening is between the first end of the sheet placing table and the end of the guide closest to the sheet placing table.

15. A sheet stacking mechanism according to claim 11, wherein the receiving member is lower than the carry-in opening.

16. A method for sequentially stacking a plurality of sheets on a sheet placing table, each of the sheets having a leading end and a trailing end spaced apart by a distance defining a length of each of the sheets, the method comprising:

feeding a leading end of a sheet from a carry-in opening toward a receiving member on the sheet placing table while the receiving member is at a position spaced from the carry-in opening by a distance less than the length of the sheet;

moving the receiving member to a position spaced from the carry-in opening greater than the length of the sheet upon a lapse of a predetermined period after the leading end of the sheet is carried onto the sheet placing table from the carry-in opening;

moving the receiving member back to the position spaced from the carry-in opening by the distance less than the length of the sheet after the trailing end of the sheet is carried onto the sheet placing table from the carry-in opening but before the leading end of a subsequent sheet is carried onto the sheet placing table from the carry-in opening.

17. The method of claim 16, wherein the step of moving the receiving member to a position spaced from the carry-in opening greater than the length of the sheet upon a lapse of a predetermined period after the leading end of the sheet is carried onto the sheet placing table from the carry-in opening comprises moving all of the sheets on the sheet placing table to the position spaced from the carry-in opening greater than the length of the sheet upon the lapse of the predetermined period after the leading end of the sheet is carried onto the sheet placing table from the carry-in opening.

18. The method of claim 17, wherein the step of moving the receiving member back to the position spaced from the carry-in opening by the distance less than the length of the sheet after the trailing end of the sheet is carried onto the sheet placing table from the carry-in opening comprises moving all of the sheets on the sheet placing table so that the carry-in opening is between the leading and trailing ends of all of the sheets on the sheet placing table.

* * * * *